US005555689A

United States Patent [19]

Gilmore

[11] Patent Number: 5,555,689

[45] **Date of Patent: * Sep. 17, 1996**

[54] PARTITION WALL FRAMING ASSEMBLY FOR SUSPENDING GYPSUM BOARD PANELS

[75] Inventor: Thomas M. Gilmore, Edmonton, Canada

[73] Assignee: Athapap Trading Company Ltd., Alberta, Canada

[ * ] Notice: The term of this patent shall not extend beyond the expiration date of Pat. No. 5,426,904.

[21] Appl. No.: 417,599

[22] Filed: Apr. 5, 1995

Related U.S. Application Data

[63] Continuation-in-part of Ser. No. 193,951, Feb. 9, 1994, Pat. No. 5,426,904.

[51] Int. Cl.[6] ..... E04B 5/52

[52] U.S. Cl. ..... 52/489.1; 52/511; 52/241

[58] Field of Search ..... 52/489.1, 489.2, 52/483.1, 481.1, 511, 721, 238.1, 241; 403/245, 246; 211/191, 192, 193

[56] References Cited

U.S. PATENT DOCUMENTS

| | | | |
|---|---|---|---|
| 3,753,325 | 8/1973 | Stanley et al. | 52/489 |
| 3,948,011 | 4/1976 | Price et al. | 53/241 |
| 4,064,996 | 12/1977 | Shillum | 211/191 |
| 4,157,228 | 6/1979 | Hammerschlag | 211/192 X |
| 4,428,172 | 1/1984 | Larsson | 52/489 |
| 4,448,004 | 5/1984 | Thorsell | 52/241 |
| 4,567,698 | 2/1986 | Morrison | 52/36 |
| 4,598,521 | 7/1986 | Slapsys et al. | 52/484 |
| 4,693,047 | 9/1987 | Menchetti | 52/664 |
| 4,704,835 | 11/1987 | Jordan | 52/489.1 |
| 4,811,539 | 3/1989 | Menchetti | 52/486 |
| 5,060,434 | 10/1991 | Allison | 52/238.1 |
| 5,216,859 | 6/1993 | Moreno et al. | 52/238.1 |

FOREIGN PATENT DOCUMENTS 1037172 7/1966 United Kingdom .

*Primary Examiner*—Kien T. Nguyen
*Attorney, Agent, or Firm*—Sheridan Ross & McIntosh

[57] ABSTRACT

A structural frame is provided comprising opposed ceiling and floor channels and spaced apart, C-shaped metal studs extending vertically between the channels. Each stud has its single central web positioned transversely relative to the main plane of the frame. Pairs of short brackets are suspended from the webs of adjacent studs in opposed and vertically spaced relation. Each bracket comprises a horizontal V-shaped wall having a pair of horizontally extending shoulders and downwardly extending side walls which form vertical end edges at the end of the bracket adjacent the web. A plurality of hooks extends from the end edges. A pattern of vertical slots is formed in the stud web and the bracket hooks extend into these slots and attach to the web. The bracket is sized to fit snugly between the side flange walls of the C-shaped stud, to reinforce these flange walls so that they do not collapse inwardly when loaded. A gypsum board panel having suspension assemblies attached to its back surface is suspended from the brackets as the suspension assembly clips engage the shoulders of the bracket. The bracket end edges bear against the web and transfer the panel load thereto, in a distributed manner so that the stud is not deformed. Each bracket is "single sided"—that is, it extends perpendicularly from only one side of the web. Thus, a stud and bracket can be used to start a wall from an abutting position with another wall.

5 Claims, 7 Drawing Sheets

PARTITION WALL FRAMING ASSEMBLY FOR SUSPENDING GYPSUM BOARD PANELS

CROSS REFERENCE TO RELATED APPLICATION

This application is a continuation-in-part of application 08/193,951, filed Feb. 9, 1994, now U.S. Pat. No. 5,426,904.

FIELD OF THE INVENTION

The present invention relates to a structural frame upon which gypsum board panels are suspended to form a removable partition wall.

BACKGROUND OF THE INVENTION

Demountable or removable partition walls are widely used in office buildings and the like. The main characteristic of these systems is that a "knock-down" structural frame is erected and removable gypsum board panels are suspended from it. Three prior art embodiments are shown in FIGS. 1–3. Having reference to the Figures, these embodiments have the following features in common:

- each panel is equipped with horizontal linear arrays of suspension assemblies mounted to the panel on its rear face;
- each suspension assembly comprises a gang nail plate, having tangs (not shown) embedded in the panel material, and a clip secured to the plate and having a downwardly, rearwardly, angled portion;
- opposed channels are mounted to the ceiling and floor;
- laterally spaced metal studs extend between the ceiling and floor channels;.
- the stud may be C-shaped (with a single web) or U-shaped (with a double web);
- each web has cut-outs at spaced positions along the vertical extent of the stud;
- horizontal support channels extend through the cut-outs and are supported by the studs;
- the floor and ceiling channels, studs and support channels combine to form a 'frame'; and
- each support channel has inwardly sloping and converging wall portions for engaging and supporting the angled portions of the clips, so that the panels are suspended by the clips from the sloping wall portions and are "cammed" or drawn in tightly against the frame.

U.S. Pat. Nos. 3,948,011 (Price et al), 4,693,047 (Menchetti) and 4,448,004 (Thorsell) are exemplary of the pertinent prior art. In both Price's and Thorsell's systems, the horizontal support channel extends continuously through adjacent studs for support. This is shown in Prior Art FIG. 2 for the Thorsell system. The suspension assembly clips engage the support channel near the studs—thus there is a portion of the continuous support channel that serves little purpose. In addition, the continuous support channel interferes with installation of wiring and the like in the wall cavity between facing panels.

In U.S. Pat. No. 4,811,539 (Menchetti) a short discontinuous support channel is disclosed (see Prior Art FIG. 3). But this short support channel requires the use of a double-webbed, U-shaped stud for support. In addition, the stud must be formed of heavy gauge (30/1000" thickness) steel, to avoid deformation at the cut-outs. These studs are difficult to manually trim on site with shears. As a result, in commercial practice the stud is supplied in conjunction with a telescoping base or "stud shoe". In addition, the U-shaped stud has one side facing out which has an open vertical slot—thus one cannot fasten with screws to this stud face (which is desirable on occasion). In practice, this leads to having to stock both U-shaped and C-shaped studs for use in the wall.

In the prior art systems, the support channels extend through and protrude from the stud. This structure cannot be used to begin a wall. Thus, in this circumstance, screws are used to secure a pair of panels to a C-shaped starting stud. The screws must then be hidden by an applied batten.

With this background in mind, it is the objective of this invention to devise short, discontinuous, "one-sided" support channels which can be used with light gauge, single webbed, C-shaped studs to provide an improved and less expensive frame.

SUMMARY OF THE INVENTION

The present invention is therefore concerned with a demountable partition wall having a novel frame for supporting suspended gypsum board facing panels.

The frame comprises:

- floor and ceiling channels;
- laterally spaced, vertical, preferably C-shaped, metal studs extending between the floor and ceiling channels;
- each stud forming one or more bracket mounting means at spaced points along its length; and
- one or more short, "one-sided" brackets or panel-support channels suspended from the stud, each bracket projecting from only one side of the stud;
- each bracket having a pair of side walls which are interconnected, preferably with a generally horizontal channel wall, said side walls forming vertical end edges which abut the stud and transfer the panel load thereto;
- the bracket's side walls preferably further having a pair of horizontally extending shoulders formed therein for engaging and supporting a rearwardly projecting clip or hanger member of a suspension assembly;
- the channel wall preferably interconnecting the side wall's shoulders and being formed with inwardly sloping and converging support surfaces for engaging the rearwardly and downwardly angled clip portion of the hanger member so that the facing panels are caused to be drawn in snugly when the clip portion engages the shoulder;
- the vertical end edges having mounting means for engaging corresponding bracket mounting means on the stud to suspend the bracket therefrom;
- said edge mounting means preferably comprising slotted hooks extending from the end edges for penetrating a matching pattern of slots in the stud's web to suspend the bracket therefrom, said hooks being capable of transferring load-induced moment to the stud;
- each hook's slot preferably having an angled surface for causing the bracket to be drawn in tightly against the web;
- the slot pattern preferably taking the form of two vertical rows, typically with three slots per row, and the bracket having one hook extending from an intermediate point on one end edge and two hooks extending from the ends of the other end edge, so that a pair of brackets can be suspended at the same elevation on the two sides of the web using a single pattern of slots;

the bracket preferably having a width selected so that it fits snugly between the two side flange walls of the C-shaped stud, so that the bracket reinforces the stud and resists inward collapse of the flange walls when the stud is loaded;

the shoulders preferably being inwardly offset from the facing panel and having means protruding from their respective side wall's distal ends for spacing opposed panels from the bracket so that the shoulders and panels remain substantially parallel.

From the foregoing, it will be noted that applicant has provided a framing assembly having "one-sided" brackets adapted to extend from only one side of the stud, thereby enabling the bracket to be used with a starting stud to initiate a wall.

Furthermore, the load is now transferred into the stud, by the mounting means associated with the end edges, over a relatively large vertical extent of the stud. This has made it possible to use light gauge (22/1000" thickness) steel in fabricating the stud, without the occurrence of stud deformation when loaded. Since the wall thickness of the steel is less, it is now possible to manually cut the studs on site and closely fit the stud between floor and ceiling channels without use of a stud shoe.

BRIEF DESCRIPTION OF THE DRAWINGS

FIGS. 1, 2 and 3 present prior art frames assemblies and removable facing panels in which:

FIG. 1 is a side elevation of a partition wall with some of the facing panels removed to expose the frame;

FIG. 2 is a partly broken away perspective view of a frame having continuous horizontal support channels;

FIG. 3 is a partly broken away perspective view of a frame having short discontinuous horizontal support channels;

FIGS. 4–10 illustrate the improved framing assembly of the present invention in which:

FIG. 4 is a side view of the partition wall system which is starting from an abutting wall. Some of the panels are removed to expose the frame;

FIG. 5 is an exploded perspective view of a pair of brackets mounted to both sides of a C-shaped stud web. A portion of a facing panel and a suspension assembly are shown engaging one bracket;

FIG. 6 is a side view of an assembled bracket and stud. The stud's flange is partially cutaway to expose the slotted hooks engaging one pattern of vertical slots;

FIG. 7 is an end view of the bracket and stud of FIG. 6 viewed along line 7—7;

FIG. 8 is a side view of a pair of brackets suspended from the same pattern of vertical slots formed in a stud. The stud's flange is partially cutaway to expose the slotted hooks engaging the pattern of vertical slots;

FIG. 9 is a top view of the two brackets and stud of FIG. 8 viewed along line 9—9. The suspension assemblies are shown engaging the brackets' support surfaces;

FIG. 10 is an exploded perspective view of a pair of brackets to show an alternate pattern of vertical slots and hooks, and an alternate form of panel spacing means;

DETAILED DESCRIPTION OF THE PREFERRED EMBODIMENT

Figure 1:
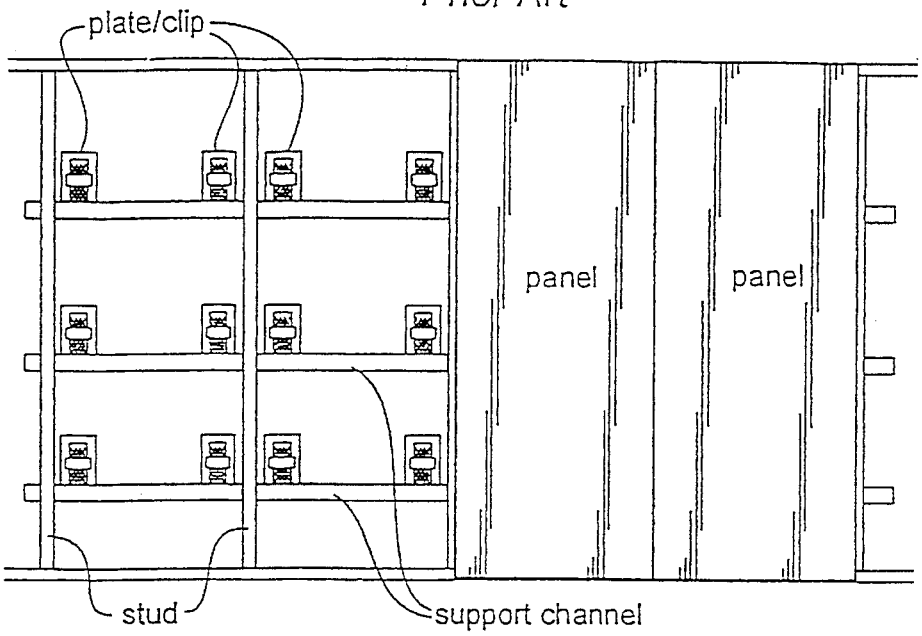
Fig. 1. Prior Art
Figure 2:
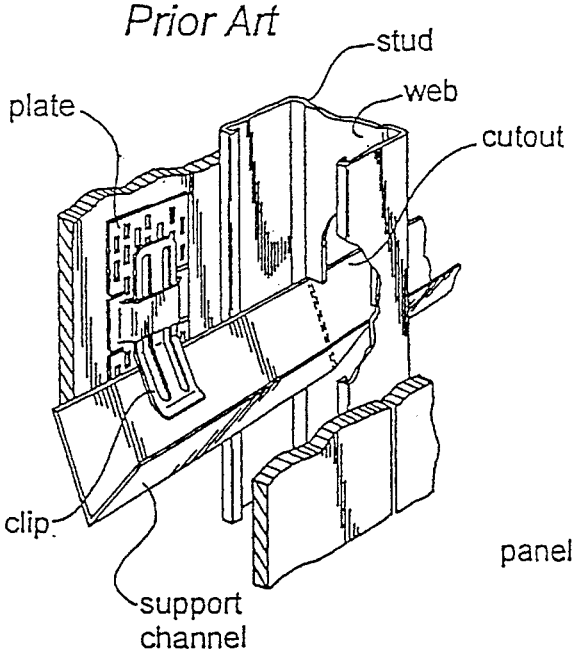
Fig. 2. Prior Art
Figure 3:
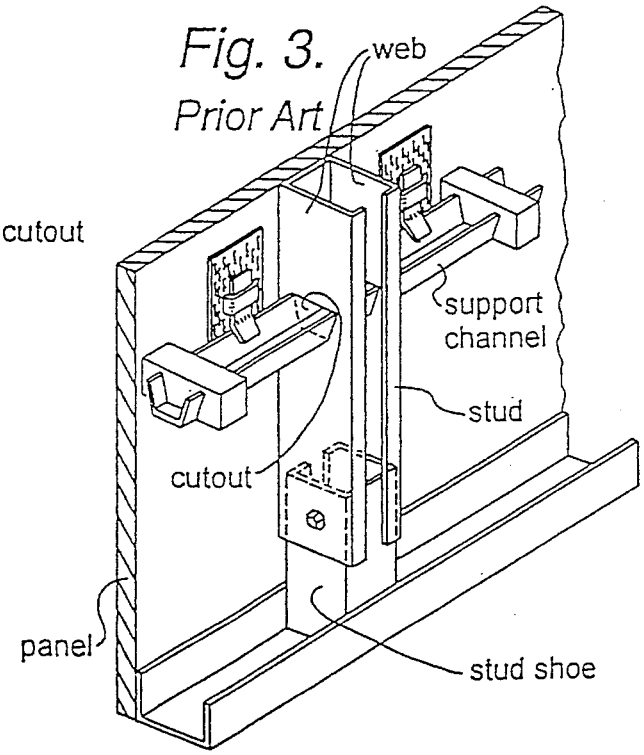
Fig. 3. Prior Art
Figure 4:
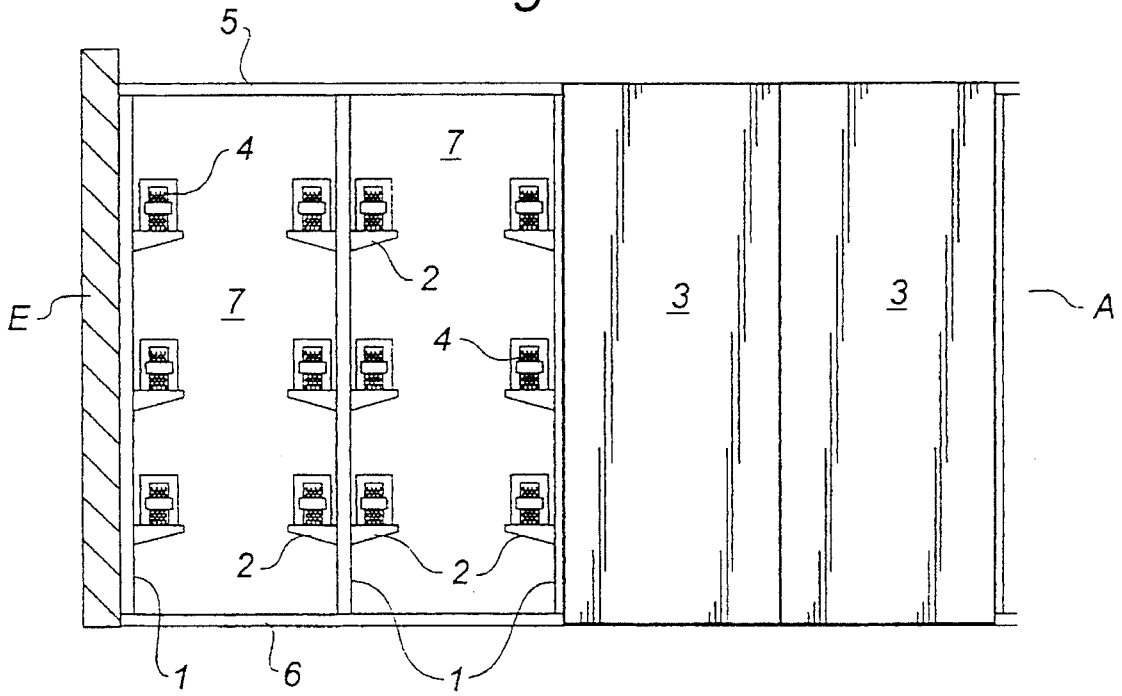

Having reference to FIG. 4, a portion of the frame of a removable partition wall A is shown to include laterally spaced, vertical stud members 1 supporting a plurality of horizontal support brackets 2. The studs 1 are fitted into the ceiling and floor channels 5,6. Gypsum board facing panels 3 are suspended from the brackets 2 by means of a plurality of suspension assemblies 4 affixed to the rear face of each panel 3. A wall cavity 7 is formed between facing panels 3 and adjacent studs 1.

Figure 5:
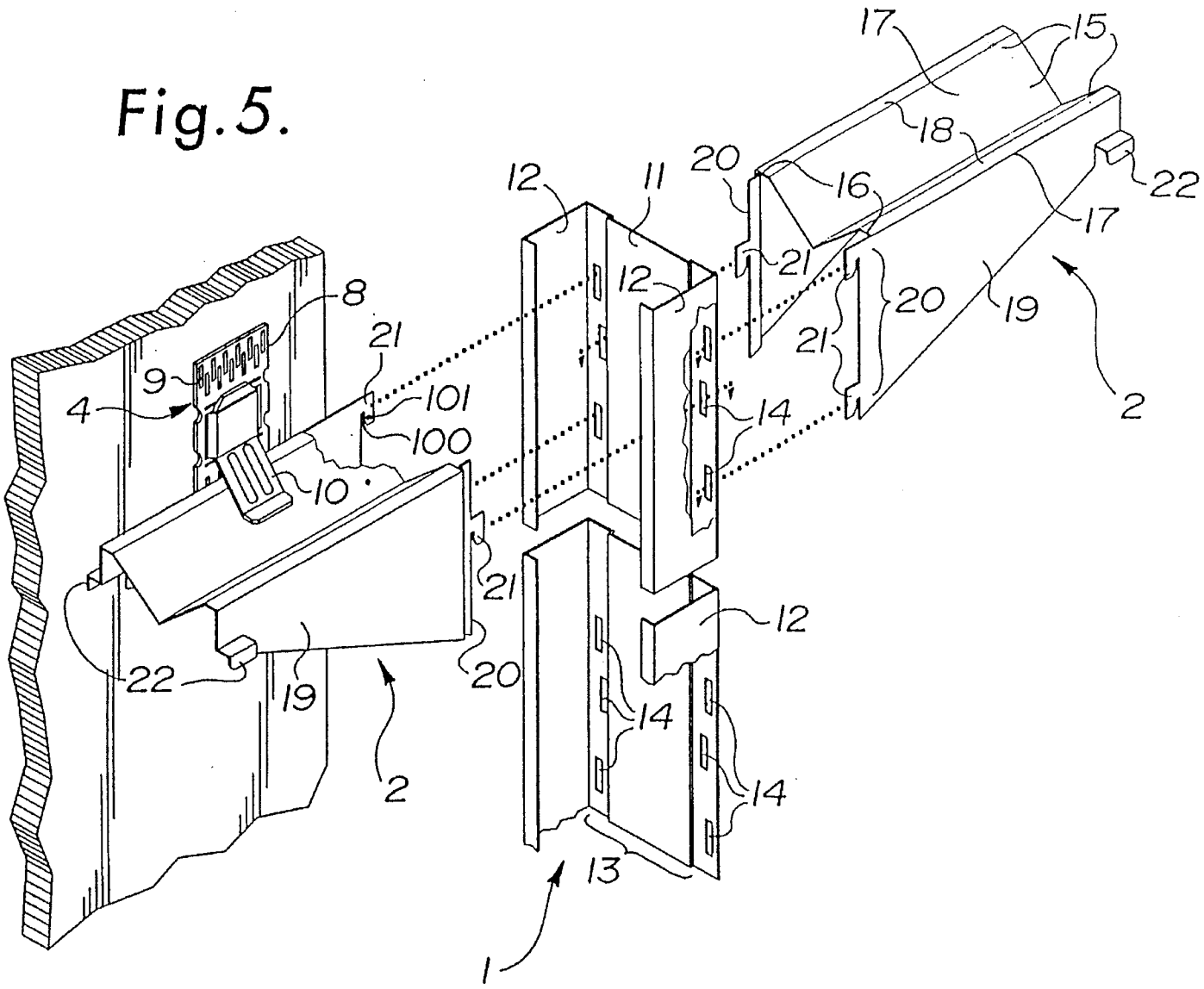

The suspension assemblies 4 suspending the gypsum board facing panels 3 are the subject of U.S. Pat. No. 3,948,011 and will only be described briefly herein. As shown in FIG. 5, each suspension assembly 4 comprises a gang nail plate 8 affixed by tangs 9 (embedded portion not shown) driven into the rear face of the facing panel 3. A hanger member in the form of a removable cam-type spring clip 10 is attached to the gang nail plate 8. The lower portion of the clip 10 is inclined rearwardly, away from the panel 3, to engage the bracket 2.

Returning to FIG. 4, individual brackets 2 are removably attached to the stud 1. Each bracket 2 projects laterally only from one face or side of the stud 1. The bracket 2 is fully supported from the stud I without significant projection of the bracket through the other side of the stud. This arrangement permits installation of a stud 1 flush to the end of a wall E, such as at an abutting wall, corner or passageway. A plurality of brackets 2 are vertically spaced along each stud 1. Optionally, brackets 2 can be attached to both sides of the stud, horizontally aligned in pairs, extending from the stud 1 in opposing directions.

Figure 6:
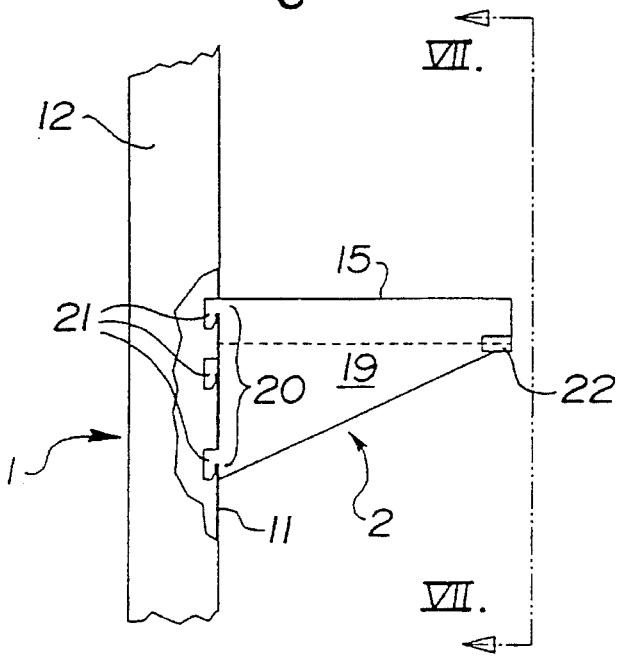
Figure 7:
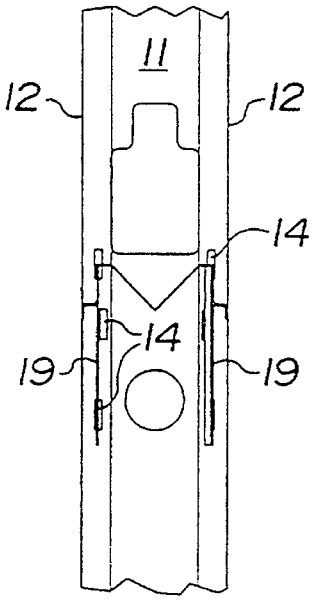

In a first embodiment and having reference now to FIGS. 5–7, each stud 1 is C-shaped, having a web 11 positioned transversely relative to the main plane of the wall A. The stud 1 has a facing pair of side walls or flanges 12. One or more mounting means, in the form of vertically spaced patterns 13 of vertical slots 14, are formed in the stud's web 11, from which the brackets 2 are mounted.

Preferably the studs 1 are C-shaped, thin-gauge steel channels. Optionally, brackets 2 can be affixed to patterns of slots 13 formed in the webs 11 of a double-webbed stud, such as the stud disclosed in Menchetti '539.

Each bracket 2 comprises a pair of side walls 19. Each side wall 19 has a proximal end 16 which in use is positioned adjacent the stud's web 11.

Support shoulders 18 are formed in each side wall 19, preferably atop the side wall. The shoulders 18 extend horizontally and outwardly with respect to a bracket-mounting stud 1, a distance sufficient to engage the hanger member or clip 10 of a suspension assembly 4, thereby suspending a panel 3. Preferably each shoulder 18 is inwardly offset from the facing panels 3. The offset and the width of the shoulder 18 cooperates with the downwardly angled suspension clip 10 to ensure that each panel is drawn into contact with the stud's flanges 12.

An interconnecting means 17, preferably in the form of a generally horizontal, V-shaped channel wall 15, spaces the side walls 19 so that their respective shoulders 18 are aligned parallel to each other and the panels 3.

The width between the side walls 19 is selected so that the bracket 2 fits snugly between the flanges 12 of the C-stud 1, thereby reinforcing the stud and maintaining the spacing between the flanges when the stud is loaded.

The side wall proximal ends 16 form substantially vertical end edges 20 for engaging and abutting the stud's web 11. The lengths of the end edges 20 (defining the height of the bracket) are sufficient to ensure that the force translated from the suspended load of the panel 3 is transferred into the stud 1 without yielding, buckling or otherwise deforming either the side walls 19 or the web 11.

When a bracket 2 is loaded with a panel 3, the bracket acts as a cantilever beam, translating the vertical load of the panel into a moment acting on the stud 1. The moment manifests as equal and opposite horizontal forces or, in other words, a "pull" and a "push" acting on the stud. Therefore, means for supporting the bracket from the, stud must be "pull-capable" at the means upper end and "push-capable" at its lower end. The greater the depth of a cantilever (in this case the height of the bracket), the less are the horizontal loads and the potential for deformation.

Mounting means, in the form of a plurality of slotted hooks 21, extend from the end edges 20 for engaging the pattern 13 of vertical slots 14 formed by the web 11. Each hook 21 is sized appropriately for penetrating a slot and engaging the web 11. Preferably each hook 21 forms a slot 100 having an angled outer surface 101 adapted to cause the bracket to be drawn in tightly against the web when engaged. The hooks 21 are spaced vertically along the end edge 20 in a pattern which is compatible with the pattern of vertical slots 13. Each hook 21 is sufficiently strong to resist deformation when loaded by the suspended panel 3.

Figure 10:
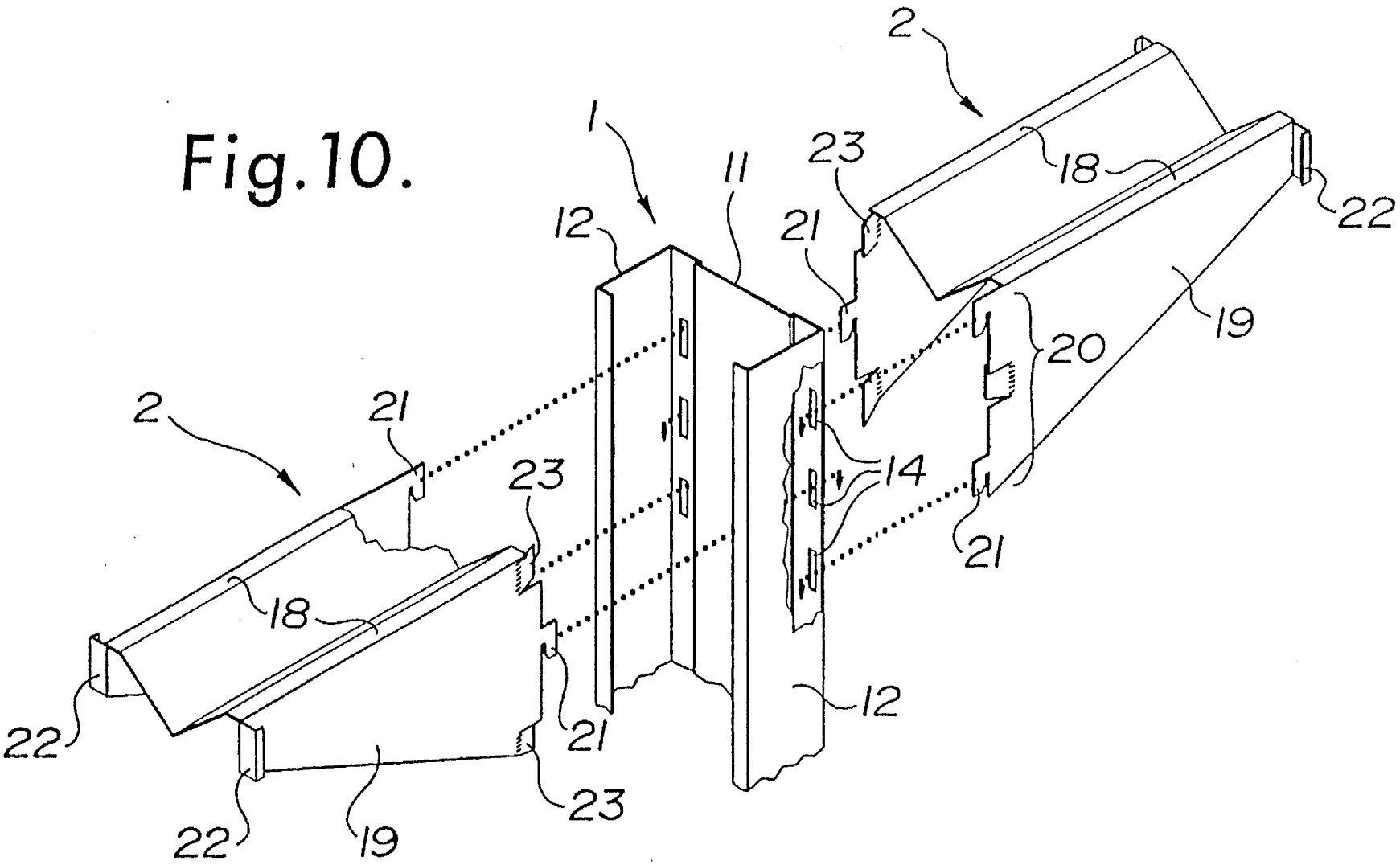
Figure 12:
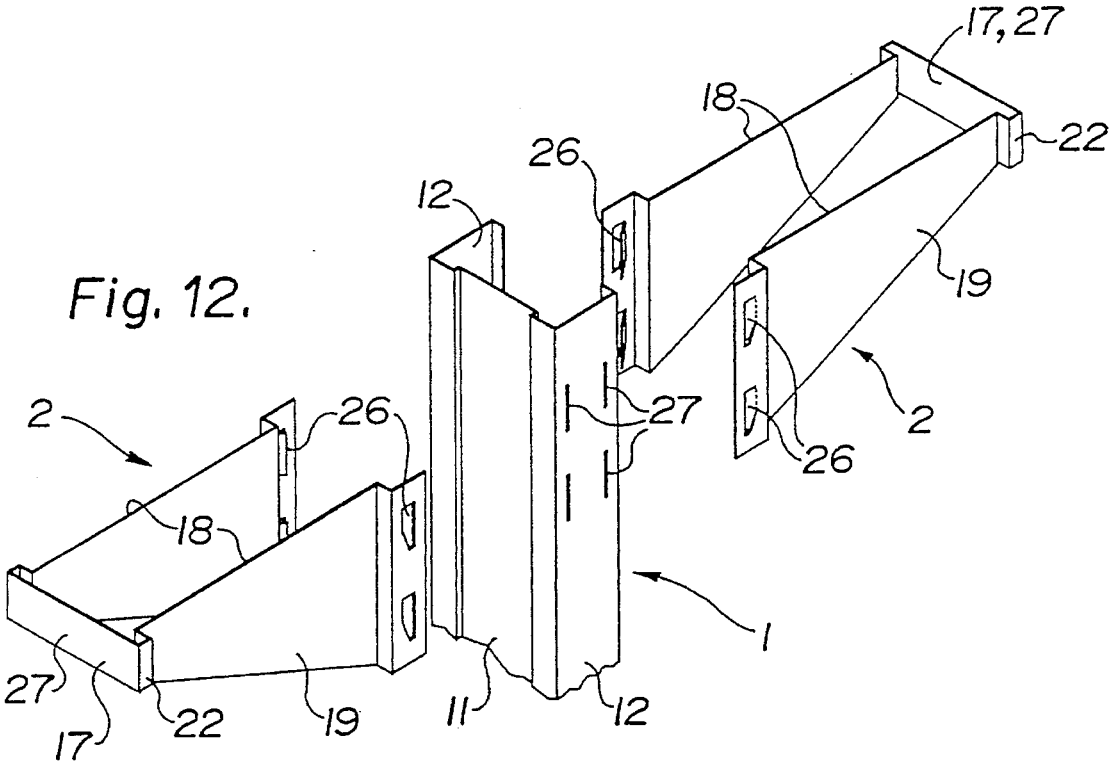
FIG. 12 is an exploded perspective view of a pair of brackets to show an alternate mounting means which engage the stud's flange walls, and shoulder interconnecting means which do not utilize a horizontal channel wall.

Panel spacing means 22 are provided at the distal end of the bracket 2, for spacing the bracket from the panel 3 so that the bracket's support shoulder 18 and the panel 3 are maintained in spaced parallel alignment. The spacing means 22 protrude outwardly from each side wall 19 and can be a small "L"-shaped tab. Alternate forms of the spacing means 22 are seen in FIGS. 5, 10 and 12.

In the particular embodiment shown in FIGS. 5–7, the bracket 2 is economically formed from a single sheet of material although other forms of construction would be suitable. Two side walls 19 are shown, providing two end edges 20. A total of three hooks 21 are located on the two end edges; two hooks 21 being located at the top and bottom of one end edge 20, a single hook being positioned intermediate the top and bottom of the other end edge. Preferably, the channel wall 15 is formed with a non-linear cross-section to improve its strength. As seen in FIGS. 5 and 7, the channel wall 15.is formed with sloped, inwardly converging support surfaces (V-shaped) for engaging and supporting the downwardly angled clips 10 of suspension assemblies 4.

When two brackets 2, which have an identical pattern of hooks 21, are horizontally aligned on opposing sides of the stud 1, there is the potential for mechanical interference between opposing hooks 21. Generally, a bracket 2 constructed of light gauge sheet metal is sufficiently flexible to permit slight deflection of opposing hooks 21, enabling them to pass and occupy the same slot 14. It is preferable, however, that the spacing and numbers of hooks 21 on each vertical end edge 20 of a bracket 2 be non-symmetrical. This enables the use of a unique slot 14 for each hook 21 of the opposing brackets 2, thereby avoiding mechanical interference.

Figure 8:
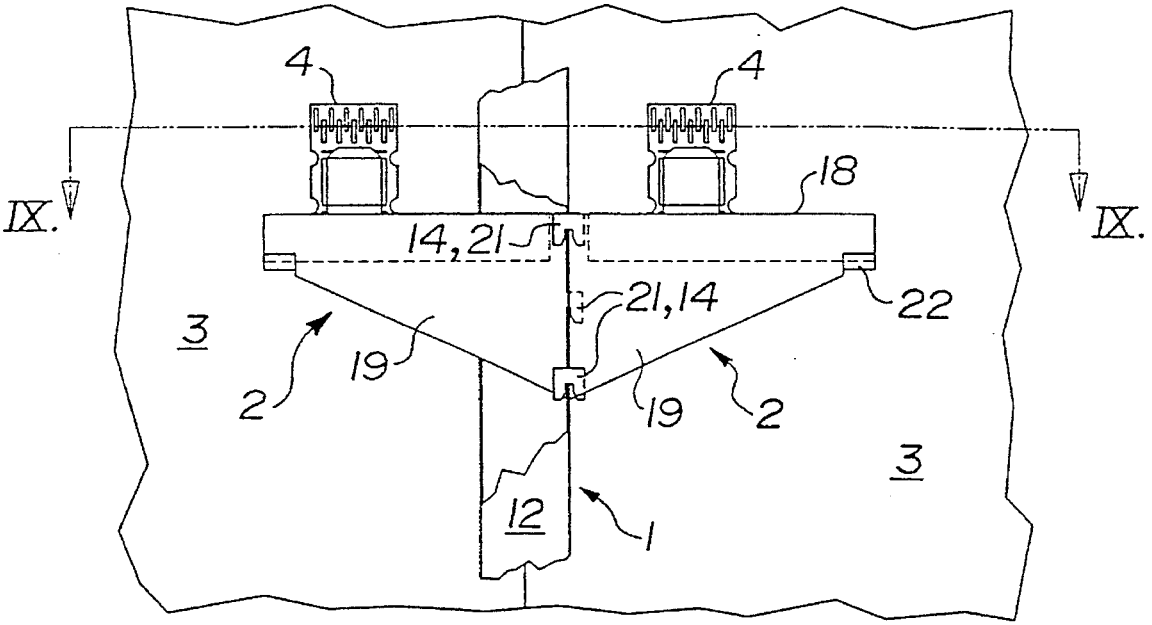
Figure 9:
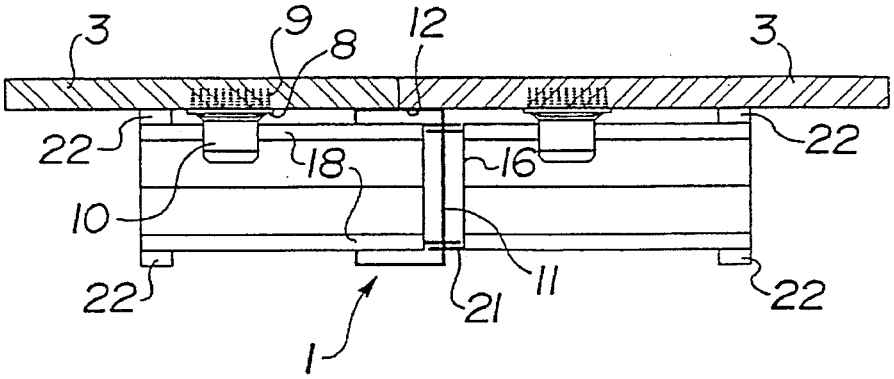

As previously stated, two hooks 21 are spaced apart widely on one end edge 20, and a single hook 21 extends from a location intermediate along the other end edge 20. As shown in FIGS. 8 and 9, this arrangement permits a six-slot pattern 13 to accommodate two opposing brackets 2,2 without multiple use of any individual slot 14. In the embodiment shown in FIGS. 5–9, the end edge 20 of one triangular-shaped side wall 19 is locally offset slightly, though still parallel to the original plane of the side wall 19, thereby avoiding hook/hook 21/21 and hook/end edge 21/20 interference.

In an alternate embodiment, as shown in FIG. 10, hook/end edge interference can be avoided by creating tangs 23 along the end edges 20, corresponding in position to an opposing bracket's hooks 21. The tangs 23 are bent inwardly to avoid interference with the hooks 21 and the stud's flanges 12.

Figure 11:
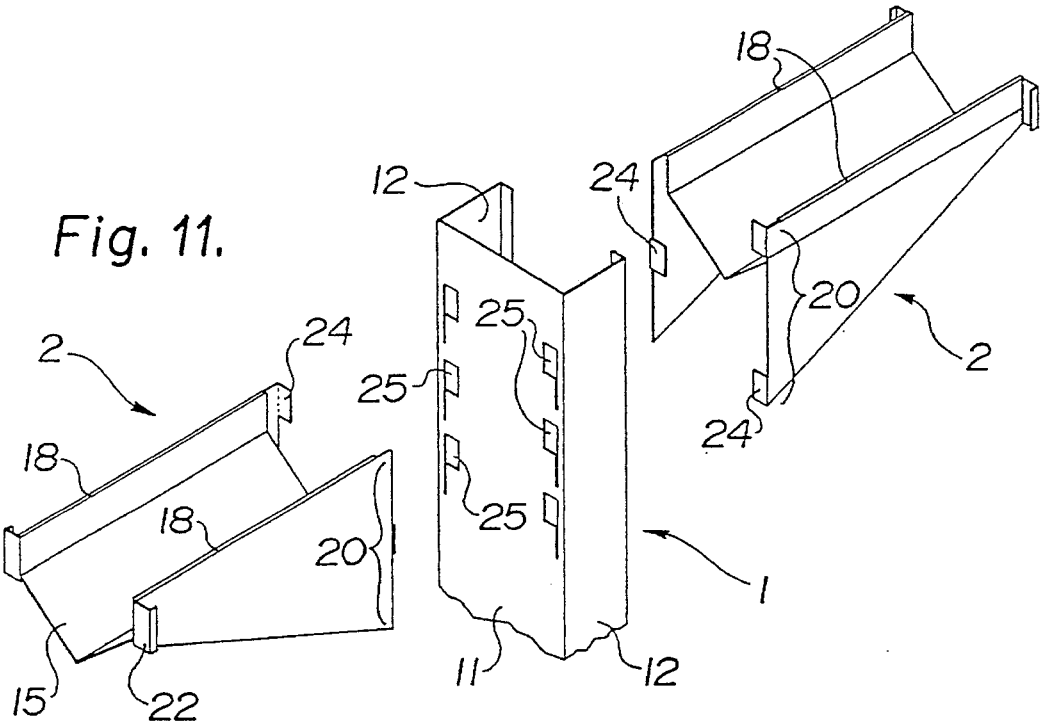
FIG. 11 is an exploded perspective view of a pair of brackets to show an alternate mounting means comprising a pattern of slotted holes and tabs, and an alternate form of the horizontal channel wall.

In another embodiment, as illustrated in FIG. 11, bracket mounting means are shown which are different from hooks/slots. Tabs 24 may be formed on the end edges 20. The tabs fit to corresponding holes/slots 25 formed in the stud's web 11. An alternate form of a horizontal channel wall 15 is also shown.

Figure 13:
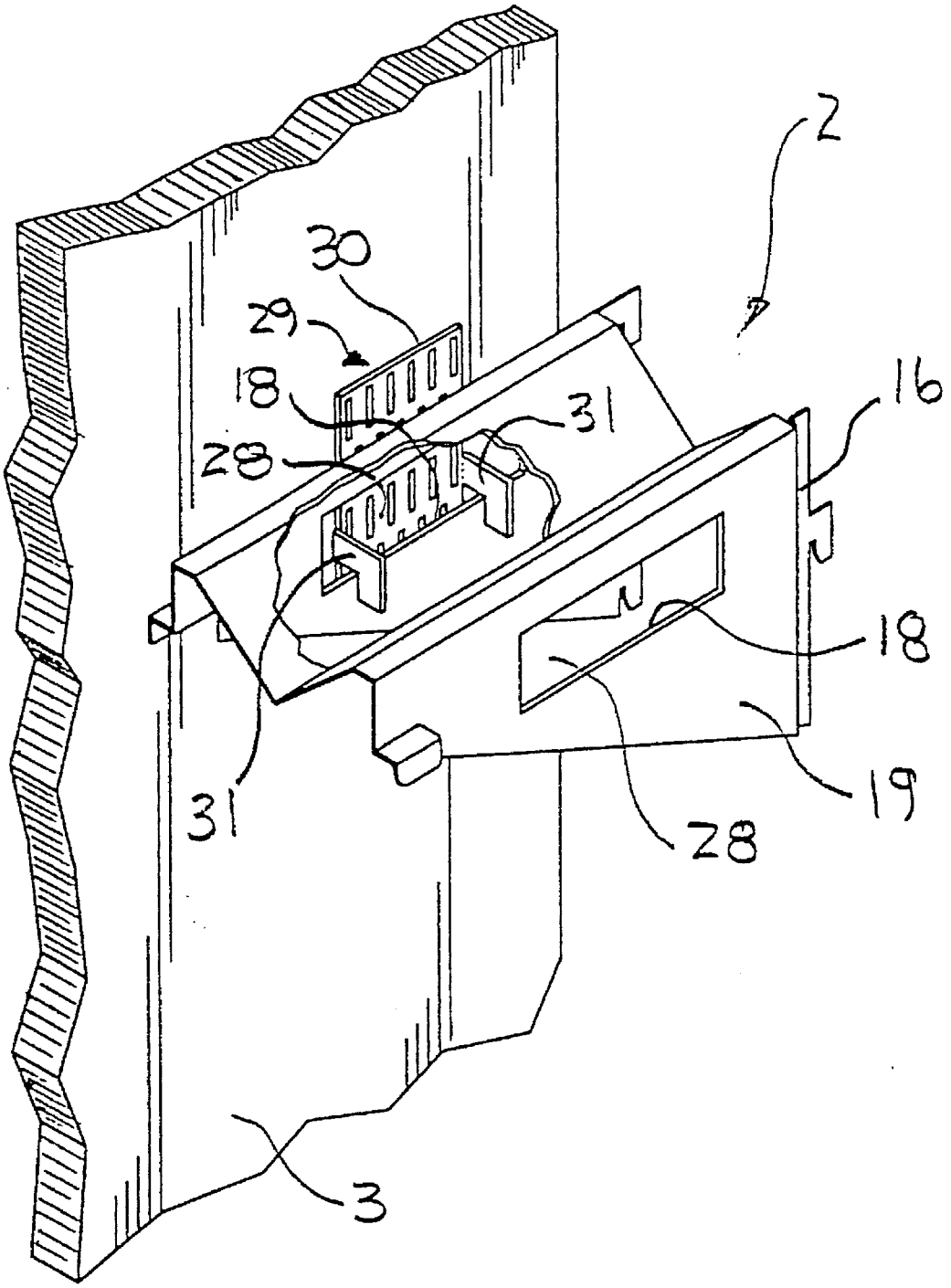
FIG. 13 is a perspective view of a bracket to show an alternate form of a shoulder formed in the side wall of the bracket of FIG. 5.

In yet another embodiment, as illustrated in FIG. 12, the bracket mounting means need not engage the stud's web at all. Instead, hooks 26 may engage slots 27 in the stud's flanges 12. The bracket's material of construction is necessarily thin to avoid introducing a noticeable "bump" in the panels exterior. Further, if the side walls 19 are sufficiently rigid, the interconnecting means 17 may comprise a single wall 27 extending between the two shoulders' distal ends. Having reference to FIG. 13, an alternate embodiment of the panel-supporting shoulder 18 is shown engaging and supporting a different form of suspension assembly. An opening 28 is formed in each of the side walls 19 of the bracket, providing shoulders 18. An alternate suspension assembly 29 is shown comprising a gang-nail plate portion 30 and a hanger member or hook portion 31 extending rearwardly from the panel. The hook 31 projects through the opening 28 to engage the shoulder 18 and thereby suspend a panel 3.

As a result of the one-sided mounting and discontinuous nature of the bracket, the following advantages are realized:

- the capability to use a standardized bracket for intermediate and end of wall applications;
- the wall cavity, formed between panels, is substantially free, providing an unobstructed passageway for the installation of electrical, communications and other service apparatus; and
- the ability to utilize only a single type of stud (C-stud) for all situations, with the associated economic benefits.

The embodiments of the invention in which an exclusive Property or Privilege is claimed are defined as follows:

1. A bracket adapted to be suspended from a vertical stud having facing flanges and a web, said bracket being further adapted to engage a suspension assembly attached to the back of a gypsum board facing panel to suspend the panel, said suspension assembly comprising a rearwardly and downwardly extending hanger member, said bracket comprising:

- a pair of parallel, vertically extending, spaced apart side walls, each having first and second ends, said first end forming a vertical end edge;
- shoulder means, associated with the side walls, adapted to engage and support the hanger members of facing panels;

the vertical end edges having projection means adapted to engage the stud to suspend the bracket from one side of the stud; and means for interconnecting the two side walls to maintain them parallel.

2. A demountable wall partition assembly comprising:

ceiling and floor channels;

a pair of spaced apart, vertical, C-shaped metal studs extending between the channels to form a partition frame, each stud having a central web that is positioned transversely to the main plane of the frame;

a gypsum board facing panel having a plurality of horizontal, vertically spaced, linear arrays of suspension assemblies attached thereto on its back face, each suspension assembly having a hanger member projecting rearwardly and downwardly therefrom;

each stud forming patterns of bracket mounting means, each pattern being generally aligned with an array of suspension assemblies; and a plurality of brackets;

each bracket comprising:

a pair of parallel, vertically extending, spaced apart side walls, each side wall having first and second ends, said first end being adjacent the stud and forming a vertical end edge;

means for interconnecting the pair of side walls to maintain them parallel;

means, associated with the side walls, adapted to engage and support a hanger member;

said end edges having means for engaging the stud's bracket mounting means so as to suspend the bracket from the stud so that the end edges bear against the stud;

so that said plurality of brackets are suspended in pairs from the studs in opposed, inwardly projecting relation at the same elevation and each pair of brackets engages the hanger members of a linear array of suspension assemblies, said brackets each extending only part way between the studs, and the panel is suspended from the brackets.

3. An assembly as set forth in claim 2 wherein:

the bracket mounting means of each stud comprises a pattern of slots formed in the web of the stud; and each bracket's vertical end edges have hooks for penetrating the slots of a stud to suspend the bracket from the stud.

4. An assembly as set forth in claim 3 wherein:

the side walls of each bracket each have outwardly protruding means adjacent their second ends for spacing the panel from the bracket so that the bracket side walls and panels are substantially parallel.

5. An assembly as set forth in claims 2, 3 or 4 wherein a V-shaped, generally horizontal wall extends between the side walls to provide the interconnecting and hanger member supporting means.

* * * * *